US006029844A

United States Patent [19]

Brady

[11] Patent Number: 6,029,844

[45] **Date of Patent: *Feb. 29, 2000**

[54] TRASH CAN LINER HAVING BAG RETENTION STRIP

[76] Inventor: John R. Brady, 20041 Osterman Rd., Lake Forest, Calif. 92630

[ * ] Notice: Under 35 U.S.C. 154(b), the term of this patent shall be extended for 516 days.

[21] Appl. No.: 08/590,388

[22] Filed: Jan. 25, 1996

Related U.S. Application Data

[63] Continuation of application No. 08/338,002, Nov. 10, 1994, abandoned.

[51] Int. Cl.[7] ..... B65D 90/00

[52] U.S. Cl. ..... 220/495.08; 220/495.11; 220/908.1; 338/210; 338/211

[58] Field of Search ..... 220/404, 908.1, 220/495.08, 495.11; 338/210, 211

[56] References Cited

U.S. PATENT DOCUMENTS

| | | | |
|---|---|---|---|
| 3,148,799 | 9/1964 | Meroney | 220/63 |
| 3,392,825 | 7/1968 | Gale et al. . | |
| 3,443,971 | 5/1969 | Wood | 99/171 |
| 3,698,594 | 10/1972 | Boehlert | 220/63 |
| 4,027,774 | 6/1977 | Cote | 220/63 R |
| 4,328,895 | 5/1982 | Jaeger | 206/496 |
| 4,335,769 | 6/1982 | McManus | 150/1 |
| 4,611,350 | 9/1986 | Kaczerwaski | 383/7 |
| 4,937,040 | 6/1990 | Holcomb et al. | 383/5 |
| 4,948,266 | 8/1990 | Bencic | 383/34 |
| 4,989,994 | 2/1991 | Gelbard | 220/404 X |
| 5,028,022 | 7/1991 | Metcalf | 220/404 X |
| 5,044,772 | 9/1991 | Larson | 383/11 |
| 5,120,138 | 6/1992 | Midgley et al. | 383/7 |
| 5,133,607 | 7/1992 | Bonke | 383/75 |
| 5,181,628 | 1/1993 | Okezie | 220/404 |
| 5,232,118 | 8/1993 | Samuel | 220/404 |
| 5,363,980 | 11/1994 | Mulcahy | 220/404 |

*Primary Examiner*—Steven Pollard
*Attorney, Agent, or Firm*—Stetina Brunda Garred & Brucker

[57] ABSTRACT

A flexible liner for insertion into a waste receptacle. The liner comprises a side wall having an upper edge and inner and outer surfaces. The liner further comprises a closed bottom and an open top defined by the upper edge of the side wall. Disposed on the outer surface of the side wall adjacent the upper edge thereof is at least one elongate, adhesive strip. The adhesive strip extends partially above the open top in generally parallel relation to the upper edge.

11 Claims, 2 Drawing Sheets

10
12
14
16
18
20
22
24
26
28
30
32
34
36
38

Fig. 8
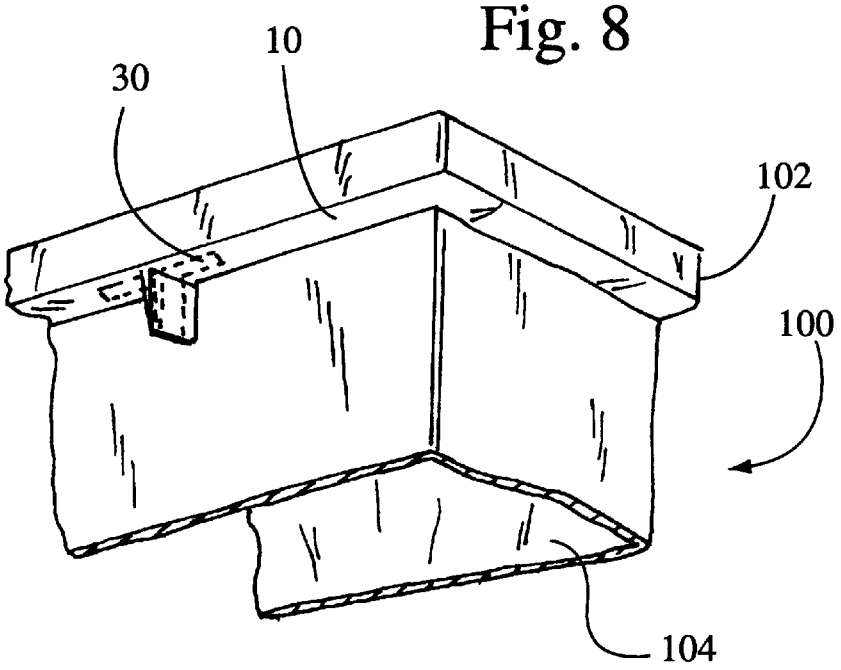
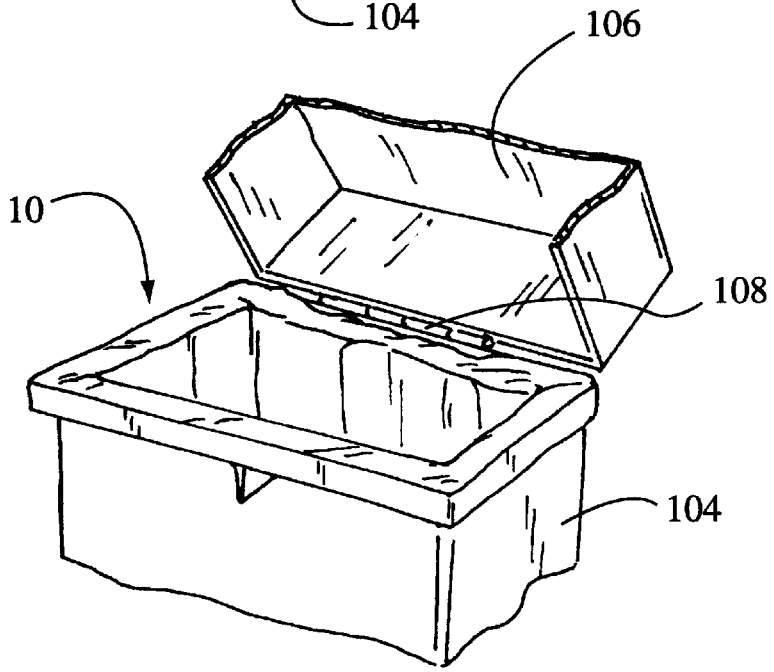
Fig. 9

TRASH CAN LINER HAVING BAG RETENTION STRIP

This application is a continuation, of application Ser. No. 08/338,002, filed Nov. 10, 1994 abandoned.

FIELD OF THE INVENTION

The present invention relates generally to plastic bags, and more particularly to a trash can liner including an adhesive retention strip for preventing the liner from slipping into the trash can or other waste receptacle when trash or litter is initially placed thereinto.

BACKGROUND OF THE INVENTION

It is common practice for a plastic bag liner to be inserted into the interior of a waste basket, garbage can or other trash receiving receptacle. Such insertion is typically accomplish by initially placing the closed bottom of the liner into the interior of the waste receptacle and subsequently folding the upper edge portion of the liner over the top edge of the waste receptacle so as to overlap the same. An annoying and time consuming problem associated with such liners occurs when trash or litter is initially placed thereinto. In this respect, when items are thrown into the liner it is commonplace for the same to slip and be forced downwardly within the interior of the waste receptacle. Such slippage of the liner typically results in subsequent material thrown into the waste receptacle landing outside of the liner, therefore necessitating the undesirable task of placing such items within the liner and repositioning the liner over the top edge of the waste receptacle.

One commonly practiced solution to the problem of liner slippage is to tie the excess portion of the upper edge or rim of the liner into a knot so as to tightly constrict the remainder of the upper edge about the open top of the waste receptacle. However, this technique is cumbersome and time consuming, and requires that the size of the liner exceed the size of the waste receptacle in an amount sufficient to create the excess needed to tie a knot in the upper edge of the liner.

In addition to the foregoing, various flexible bag liners have been developed in the prior art which include inserts for attaching the liner to the open top of a trash container. One such insert comprises an elastic band which is located in a hem at the open top of the trash bag liner along its full circumference. Another insert comprises a collapsible cardboard strip which is also located at the top of the trash bag liner and used to hold the liner in an open configuration. However, the construction of the prior art trash bag liners with the aforementioned inserts presents disadvantages in terms of cost, manufacturing and packaging. In this respect, such liners typically may not be provided in the form of a continuous roll with intermittent perforations, but rather, must be provided as individual units in a dispensing box or similar package. The present invention is designed to alleviate the deficiencies associated with prior art bag liners.

SUMMARY OF THE INVENTION

In accordance with the present invention, there is provided a flexible liner for insertion into a waste receptacle. The liner, which comprises a side wall having an upper edge and inner and outer surfaces, includes a closed bottom and an open top defined by the upper edge of the side wall. Disposed on the outer surface of the side wall adjacent the upper edge thereof is at least one elongate adhesive strip. The adhesive strip extends partially about the open top in generally parallel relation to the upper edge.

In the preferred embodiment, the side wall itself comprises at least two side panels which have generally rectangular configurations and define inner and outer surfaces, upper and lower edges and opposed side edges. The lower and side edges are joined to each other in a manner wherein the inner surfaces face each other, the closed bottom of the liner is defined by the lower edges and the open top of the liner is defined by the upper edges. The adhesive strip itself is disposed on the outer surface of one of the side panels. The side panels are preferably fabricated from a thermoplastic film.

The adhesive strip preferably has a length which is substantially less than the width of each of the side panels of the liner. Additionally, the adhesive strip defines opposed ends and is positioned on the outer surface of one of the side panels such that one of its opposed ends is disposed adjacent one of the side edges of the side panel. The adhesive strip also preferably includes a paper release covering applied thereto, and is exposed by the selective removal of the paper release covering therefrom. In the preferred embodiment, the adhesive strip comprises a segment of tape defining opposed faces having layers of adhesive applied thereto, with one face of the tape segment being adhered to the outer surface of the side panel. Alternatively, the adhesive strip may comprise a layer of adhesive which is applied directly to the outer surface of the side panel.

The liner constructed in accordance with the present invention is typically inserted into a waste receptacle which includes a side wall defining a top edge. In particular, the liner is inserted into the interior of the waste receptacle closed bottom first, with the upper edge thereof then being folded or rolled over the top edge of the waste receptacle such that a portion of the outer surface adjacent the upper edge and the adhesive strip overlap the side wall of the waste receptacle. Subsequent to the removal of the paper release covering therefrom, the adhesive strip is crimped together to tightly constrict the upper edge of the liner about the top edge of the waste receptacle, thus maintaining the liner in firm engagement thereto.

BRIEF DESCRIPTION OF THE DRAWINGS

These, as well as other features of the present invention will become more apparent upon reference of the drawings wherein:

FIGS. 8 and 9 are partial perspective views illustrating the manner in which the liner is interfaced to a waste receptacle having an outwardly extending rim and integral lid.

DETAILED DESCRIPTION OF THE PREFERRED EMBODIMENT

Figures 1, 2, 3, 4, 5, 6, 7:
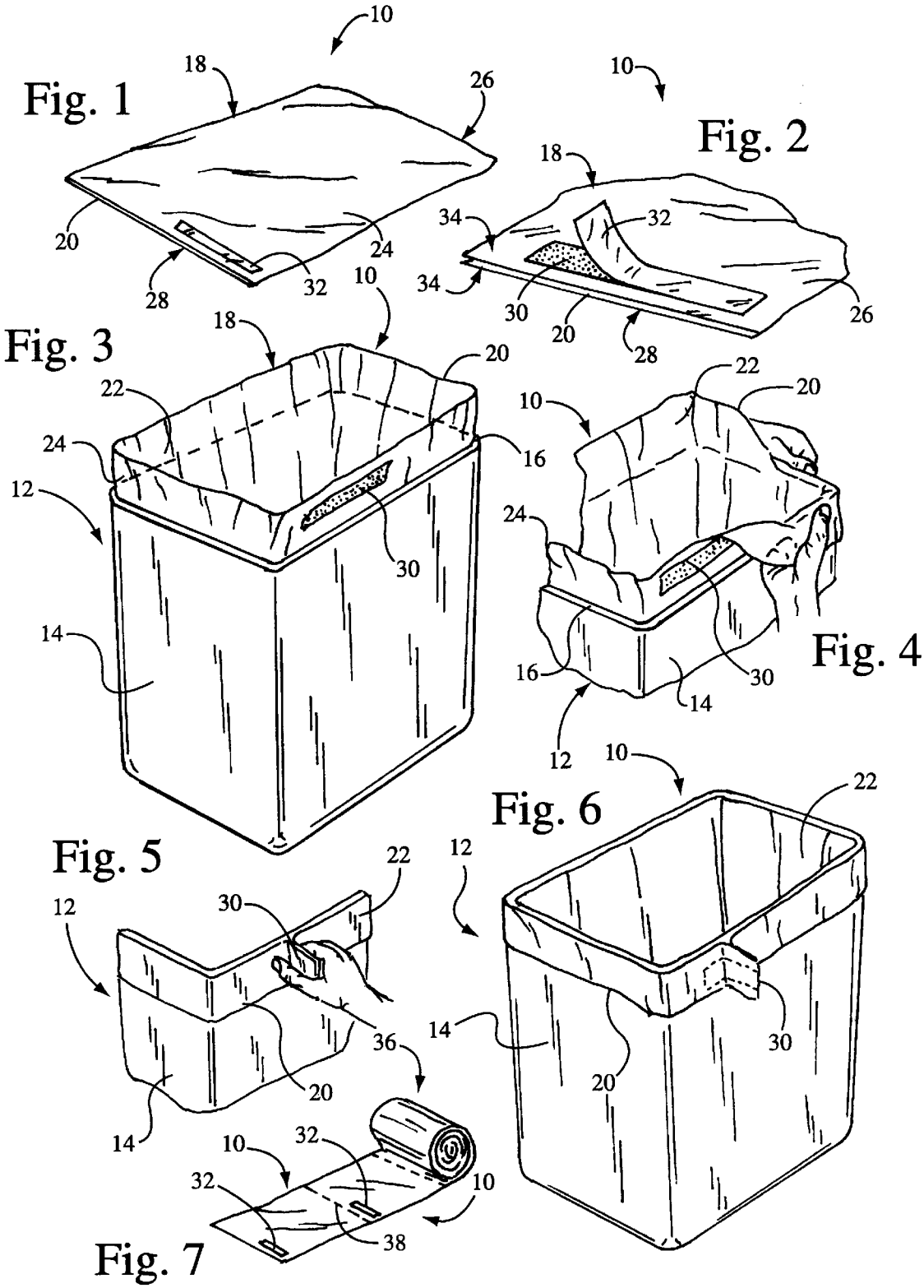
FIG. 1 is a perspective view of a flexible liner constructed in accordance with the present invention.
FIG. 2 is a partial perspective view of the adhesive strip included with the liner, illustrating the manner in which the paper release covering is removed therefrom.
FIG. 3 is a perspective view illustrating the manner in which the liner is initially inserted into a waste receptacle.
FIG. 4 is a perspective view illustrating the manner in which the upper edge of the liner is rolled over the top edge of the waste receptacle.
FIG. 5 is a partial perspective view illustrating the manner in which the adhesive strip is crimped to constrict the upper edge of the liner about the top edge of the waste receptacle.
FIG. 6 is a perspective view illustrating the liner as secured to the waste receptacle.
FIG. 7 is a perspective view illustrating a roll comprising liners constructed in accordance with the present invention.

Referring now to the drawings wherein the showings are for purposes of illustrating a preferred embodiment of the present invention only, and not for purposes of limiting the same, FIG. 1 perspectively illustrates a flexible liner 10 constructed in accordance with the present invention. As seen in FIG. 3, the liner 10 is typically inserted into a waste receptacle 12 such as a waste basket, trash/garbage can or the like. The waste receptacle 12 includes a continuous vertical wall 14 which defines a top edge 16. Though the waste receptacle 12 shown in FIGS. 3–6 has a generally rectangular cross-sectional configuration and defines four (4) distinct corner regions, it will be recognized that the liner 10 constructed in accordance with the present invention may also be used in conjunction with waste receptacles having square, circular, oval or other cross-sectional configurations.

Referring now to FIGS. 1 and 2, the liner 10 preferably comprises a continuous side wall 18 which includes an upper edge 20, an inner surface 22 and an outer surface 24. The liner 10 also comprises a closed bottom 26 and an open top 28 which is defined by the upper edge 20 of the side wall 18. Disposed on the outer surface 24 of the side wall 18 adjacent the upper edge 20 thereof is an elongate adhesive strip 30. The adhesive strip 30 extends partially about the open top 28 of the liner 10 in generally parallel relation to the upper edge 20 of the side wall 18. The adhesive strip 30 preferably comprises a segment of tape having layers of pressure sensitive adhesive applied to the opposed faces thereof. One face of the tape segment is adhered to the outer surface 24 of the side wall 18, with the exposed face preferably including a paper release covering 32 adhered thereto. Alternatively, the adhesive strip 30 may comprise a layer of adhesive which is applied directly to the outer surface 24 of the side wall 18 and includes the paper release covering 32 adhered thereto. As will be recognized, the covering 32 is used to protect the adhesive on the adhesive strip 30 until its use is desired. In this respect, the adhesive strip 30 is exposed by selectively removing the covering 32 therefrom in the manner shown in FIG. 2. The length and width of the covering 32 is preferably identical to that of the adhesive strip 30. However, the covering 32 may be fabricated having length and/or width dimensions which exceed those of the adhesive strip 30 to aid in its removal therefrom.

In the preferred embodiment, the side wall 18 itself comprises a pair of identically configured side panels 34 which have inner and outer surfaces, upper and lower edges and opposed side edges. The lower and side edges of the side panels 34 are joined to each other in a manner wherein the inner surfaces thereof face each other and, in combination, define the inner surface 22. The joined lower edges of the side panels 34 define the closed bottom 26 of the liner 10, with the upper edges thereof, in combination, defining the upper edge 20 and hence the open top 28 of the liner 10. The adhesive strip 30 is disposed on the outer surface of one of the side panels 34 adjacent the upper edge thereof.

As best seen in FIGS. 1 and 2, the adhesive strip 30 has an overall length which is substantially less than the width of the side panel 34 upon which it is positioned, and is oriented on the outer surface of the side panel 34 such that one of its opposed ends is disposed adjacent one of the side edges of the side panel 34, with the adhesive strip 30 extending in generally parallel relation to the upper edge thereof. Though the adhesive strip 30 is shown in FIGS. 1–4 and 6 as being spaced from the upper edge of the side panel 34, it will be recognized that the adhesive strip 30 may be oriented so as to extend directly along the upper edge with no space or gap being defined between it and the upper edge. When the adhesive strip 30 is oriented in this manner, the paper release covering 32 adhered thereto is preferably sized having a length which is identical to that of the adhesive strip 30 and a width which slightly exceeds that of the adhesive strip 30. In this respect, the paper release covering 32 is preferably adhered to the adhesive strip 30 in a manner wherein the adhesive strip 30 is completely covered thereby, with the excess width of the paper release covering 32 extending beyond the upper edge of the side panel 34 so as to be easily graspable by the user's hand.

In the preferred embodiment, the side panels 34 have generally rectangular configurations and are fabricated from thermoplastic film, though other materials may be utilized as an alternative. Though the side wall 18 of the liner 10 is preferably formed by the side panels 34, it will be recognized that the same may alternatively be formed from a single sheet which is folded in half and joined along its edges in a manner facilitating the formation of a continuous side wall, closed bottom and open top. Additionally, the liner 10 may be formed from multiple sheets or panels which are joined to each other in a manner facilitating the formation of a continuous side wall, closed bottom and open top.

Referring now to FIGS. 3–6, the liner 10 is utilized by initially inserting the same into the interior of the waste receptacle 12. As will be recognized, the closed bottom 26 of the liner 10 is the first portion thereof inserted into the waste receptacle 12. The length of the side wall 18 is preferably sized such that when the liner 10 is fully inserted into the waste receptacle 12, the upper edge 20 of the side wall 18 protrudes upwardly beyond the top edge 16 of the waste receptacle 12.

Subsequent to the insertion of the liner 10 into the waste receptacle 12 in the manner shown in FIG. 3, the upper edge 20 of the side wall 18 is folded or rolled over the top edge 16 of the waste receptacle 12 in the manner shown in FIG. 4 such that both a portion of the outer surface 24 adjacent the upper edge 20 and the adhesive strip 30 overlap the wall 14 of the waste receptacle 12. Thereafter, the paper release covering 32 is removed from the adhesive strip 30. The adhesive strip 30 is then crimped together in the manner shown in FIG. 5 to tightly constrict the upper edge 20 of the side wall 18 about the top edge 16 of the waste receptacle 12. Once the adhesive strip 30 has been crimped in the proper manner, the liner 10, and in particular the upper edge 20, is secured to the waste receptacle 12 in the manner shown in FIG. 6.

As further seen in FIG. 6, the adhesive strip 30 is preferably crimped in a manner wherein the central portion thereof is adhered to itself, with the opposed end portions thereof remaining in overlapped relation to the wall 14 of the waste receptacle 12. In this respect, the end portions of the adhesive strip 30 may be pressed against and therefore adhered to the wall 14, thus further aiding in the prevention of the slippage of the liner 10 into the waste receptacle 12. The removal of the liner 10 from within the waste receptacle 12 is typically accomplished by grasping the crimped portion thereof in the manner shown in FIG. 5, and subsequently pulling the liner 10 upwardly out of the interior of the waste receptacle 12.

Though not shown, as an alternative to being crimped in a manner wherein the central portion thereof is adhered to itself, the adhesive strip 30 may be crimped in a manner wherein the same is adhered only to the side wall 18, and in particular a portion of the outer surface 24 thereof adjacent the upper edge 20. Typically, when the exposed adhesive strip 30 is crimped exclusively against (i.e., adhered directly to) the outer surface 24 of the side wall 18, no portion thereof will remain in overlapped relation to the wall 14 of the waste receptacle 12. As such, the adhesive strip 30 will not be pressed against and adhered to the wall 14 of the waste receptacle 12. It will be recognized that the crimping of the adhesive strip 30 against the outer surface 24 of the side wall 18 also facilitates the tight constriction of the upper edge 20 about the top edge 16 of the waste receptacle 12.

The liner 10 constructed in accordance with the present invention may be utilized with a waste receptacle 100 which is substantially identical to the previously described waste receptacle 12, but further includes a continuous rim 102 which extends outwardly from the top edge of the vertical wall 104 thereof and/or a lid member 106 which is attached to the wall 104 via a hinge 108 and selectively openable and closable (typically through the utilization of a foot peddle). The attachment of the liner 10 to the waste receptacle 100 including the outwardly extending rim 102 is accomplished in the same manner previously described. In this respect, the adhesive strip 30 is crimped underneath the rim 102 of the waste receptacle 100. Advantageously, the resultant constriction of the upper edge 20 of the side wall 18 about the wall 104 of the waste receptacle 100 underneath the rim 102 thereof causes the rim 102 to aid in holding the liner 10 and preventing the slippage thereof into the waste receptacle 100. In the event the waste receptacle 100 includes the lid member 106 in addition to the rim 102, a portion of the upper edge 20 of the side wall 18 is simply extended about the front of the associated hinge 108, with the remainder of the upper edge 20 being folded over the rim 102 and tightly constricted about the wall 104 of the waste receptacle 100 underneath the rim 102 thereof by the crimping of the adhesive strip 30 in the aforementioned manner.

Advantageously, the crimping of the adhesive strip 30 against itself or the side wall 18 in the aforementioned manner is accomplished quickly and easily, thus allowing the liner 10 to be secured to the waste receptacle 12 with a minimal amount of difficulty. Additionally, since the adhesive strip 30 is simply applied to the outer surface 24 of the side wall 18, the liner 10 need not be specially manufactured to include hems or pockets to accommodate elastic bands or cardboard stiffeners. In this respect, the configuration of the liner 10 lends itself to ease in manufacturing and packaging, and is less costly to produce than other prior art plastic bag liners which are adapted to be secured to a waste receptacle. As shown in FIG. 7, unlike most prior art plastic bag liners which must be supplied as separate units within a box or package due to their inclusion of a securing means, the liners 10 constructed in accordance with the present invention may be provided in the form of a roll 36. In the roll 36, the liners 10 are provided as a continuous sheet which includes laterally extending perforations 38 disposed at equidistantly spaced intervals along the entire length thereof.

Additional modifications and improvements of the present invention may also be apparent to those skilled in the art. Thus, the particular combination of parts described and illustrated herein is intended to represent only one embodiment of the present invention, and is not intended to serve as limitations of alternative devices within the spirit and scope of the invention.

What is claimed is:

1. A flexible liner for insertion into a waste receptacle, said liner comprising:

at least two side panels having inner and outer surfaces, upper and lower edges and opposed side edges, the lower and side edges being joined to each other in a manner wherein the inner surfaces face each other, a closed bottom is defined by the lower edges and an open top is defined by the upper edges; and at least one elongate, adhesive strip disposed on the outer surface of one of said side panels adjacent the upper edge thereof, said adhesive strip having a length which is substantially less than the width of each of the side panels and extending along the open top in generally parallel relation to one of the upper edges.

2. The flexible liner of claim 1 wherein said adhesive strip defines opposed ends and is positioned on the outer surface of one of the side panels such that one of the opposed ends thereof is disposed adjacent one of the side edges of the side panel.

3. The flexible liner of claim 1 wherein said side panels have generally rectangular configurations.

4. The flexible liner of claim 1 wherein said side panels are fabricated from thermoplastic film.

5. The flexible liner of claim 1 wherein said adhesive strip includes a paper release covering applied thereto and is exposed by the selective removal of the paper release covering therefrom.

6. The flexible liner of claim 1 wherein said adhesive strip comprises a segment of tape defining opposed faces having layers of adhesive applied thereto, one face of the tape segment being adhered to the outer surface of the side panel.

7. The flexible liner of claim 1 wherein said adhesive strip comprises a layer of adhesive applied directly to the outer surface of the side panel.

8. A method of inserting a flexible liner into a waste receptacle having a side wall defining a top edge, said method comprising the steps of:

forming the liner to include inner and outer surfaces, an open top defined by an upper edge, a closed bottom and an elongate adhesive strip disposed on the outer surface adjacent the upper edge;

inserting the liner into the interior of the waste receptacle closed bottom first;

rolling the upper edge of the liner over the top edge of the waste receptacle such that a portion of the outer surface adjacent the upper edge and the adhesive strip overlap the side wall; and crimping the adhesive strip against itself to tightly constrict the upper edge of the liner about the top edge of the waste receptacle.

9. The method of claim 10 further comprising the step of removing a paper release covering from the adhesive strip prior to the crimping thereof.

10. A method of inserting a flexible liner into a waste receptacle having a side wall defining a top edge, said method comprising the steps of:

forming the liner to include inner and outer surfaces, an open top defined by an upper edge, a closed bottom and an elongate adhesive strip disposed on the outer surface adjacent the upper edge;

inserting the liner into the interior of the waste receptacle closed bottom first;

rolling the upper edge of the liner over the top edge of the waste receptacle such that a portion of the outer surface adjacent the upper edge and the adhesive strip overlap the side wall; and crimping the adhesive strip against a portion of the outer surface of the liner adjacent the upper edge to tightly constrict the upper edge oft the liner about the top edge of the waste receptacle.

11. The method of claim 10 further comprising the step of removing a paper release covering from the adhesive strip prior to the crimping thereof.

* * * * *